US007689427B2

(12) United States Patent
Vasilache

(10) Patent No.: US 7,689,427 B2
(45) Date of Patent: Mar. 30, 2010

(54) METHODS AND APPARATUS FOR IMPLEMENTING EMBEDDED SCALABLE ENCODING AND DECODING OF COMPANDED AND VECTOR QUANTIZED AUDIO DATA

(75) Inventor: Adriana Vasilache, Tampere (FI)

(73) Assignee: Nokia Corporation, Espoo (FI)

( * ) Notice: Subject to any disclaimer, the term of this patent is extended or adjusted under 35 U.S.C. 154(b) by 828 days.

(21) Appl. No.: 11/485,076

(22) Filed: Jul. 11, 2006

(65) Prior Publication Data

US 2007/0094027 A1 Apr. 26, 2007

Related U.S. Application Data

(63) Continuation-in-part of application No. 11/256,670, filed on Oct. 21, 2005, now abandoned.

(60) Provisional application No. 60/818,031, filed on Jun. 30, 2006.

(51) Int. Cl.
*G10L 21/00* (2006.01)

(52) U.S. Cl. ..... 704/500

(58) Field of Classification Search ..... 704/500
See application file for complete search history.

(56) References Cited

U.S. PATENT DOCUMENTS

| | | | | |
|---|---|---|---|---|
| 6,122,618 | A | 9/2000 | Park | 704/500 |
| 6,529,604 | B1 | 3/2003 | Park et al. | 381/22 |
| 7,092,576 | B2 * | 8/2006 | Srinivasan et al. | 382/238 |
| 7,099,515 | B2 * | 8/2006 | Lin et al. | 382/240 |
| 7,317,839 | B2 * | 1/2008 | Holcomb | 382/236 |
| 7,499,495 | B2 * | 3/2009 | Srinivasan | 375/240.16 |
| 7,548,853 | B2 * | 6/2009 | Shmunk et al. | 704/219 |
| 2005/0285764 | A1 | 12/2005 | Bessette et al. | 341/143 |

FOREIGN PATENT DOCUMENTS

WO WO-03/096326 A2 11/2003

OTHER PUBLICATIONS

"LSF Quantization With Multiple Scale Lattice VQ For Transmission Over Noisy Channels", Adriana Vasilache et al., In Proceedings of the European Conference of Signal Processing, Toulouse, France, Sep. 3-6, 2002., 4 pages.

(Continued)

*Primary Examiner*—Susan McFadden
(74) *Attorney, Agent, or Firm*—Harrington & Smith

(57) ABSTRACT

The invention concerns a scalable version of an audio encoder based on lattice quantization of companded audio data, wherein the scalability is achieved using bitplane encoding. In methods and apparatus of the invention, a time-domain to discrete-frequency-domain transformation is performed on an audio signal, creating a plurality of frequency domain coefficients. The frequency domain coefficients are organized subband-wise; scaled; companded; and vector quantized using a lattice quantization method, creating scaled, companded and vector quantized coefficient vectors for each subband. Side information comprising an exponent of the scaling factor and the maximum norm of the quantized vector are generated for each subband. The side information is used to calculate the relative importance of the subbands. The subband frequency domain coefficients are then bitplane encoded in order of subband importance, creating an embedded, scalable bitstream from which the encoded audio information can be recovered at finely scalable bit rates. Decoders operating in accordance with the invention decode the scalable bitstream generally by performing the inverse of the encoding operations at a selected bitrate.

30 Claims, 6 Drawing Sheets

OTHER PUBLICATIONS

"Embedded Audio Coding (EAC) With Implicit Auditory Masking", Jin Li, ACM Multimedia, Nice, France, Dec. 1-6, 2002, 10 pages.

Efficient Audio Coding with Fine-Grain Scalability, Chris Dunn, AES 111th Convention, New York, NY, USA, Sep. 21-24, 2001, pp. 1-6.

"An Efficient, Fine-Grain Scalable Audio Compression Scheme", Huan Zhou et al., AES 118th Convention, Barcelona, Spain, May 28-31, 2005, pp. 1-8.

"From Lossy To Lossless Audio Coding Using SPIHT", Mohammed Raad et al., Proc. Of the 5th Int. Conference on Digital Audio Effects, Hamburg, Germany, Sep. 26-28, 2002, pp. 245-250.

"Multi-Layer Bit-Sliced Bit-Rate Scalable Audio Coding", Sung-Hee Park et al., AES 103rd Convention, Sep. 26-29, 1997, New York, New York, 18 pages.

"Information technology—Coding of audio-visual objects—Part 3: Audio", ISO/IEC JTC1/SC29/WG11, ISO/IEC 14496-3:2001 (E), 94 pages.

* cited by examiner

METHODS AND APPARATUS FOR IMPLEMENTING EMBEDDED SCALABLE ENCODING AND DECODING OF COMPANDED AND VECTOR QUANTIZED AUDIO DATA

CROSS REFERENCE TO RELATED UNITED STATES PATENT APPLICATIONS

This application hereby claims priority under 35 U.S.C. §119(e) from copending provisional U.S. Patent Application Ser. No. 60/818,031 entitled "Methods and Apparatus for Implementing Embedded Scalable Encoding of Companded and Vector Quantized Audio Data" filed on Jun. 30, 2006 by Adriana Vasilache and under 35 U.S.C. §120 from U.S. patent application Ser. No. 11/256,670, entitled "Audio Coding Using Vector Quantization of Companded Data" filed on Oct. 21, 2005 now abandoned by Adriana Vasilache. The present application is a continuation-in-part of U.S. patent application Ser. No. 11/256,670. The disclosure of these United States Patent Applications are hereby incorporated by reference in their entirety as if fully restated herein.

TECHNICAL FIELD

The invention generally concerns audio encoding and decoding technology and more particularly concerns scalable versions of audio encoders and decoders based on lattice quantization of companded data, wherein scalability is achieved using bitplane encoding.

BACKGROUND

Lossy compressed audio formats have been known for over a decade, and audio devices capable of playing back content encoded in lossy compressed audio formats have been available for over half a decade. Lossy compressed audio formats overcame limitations associated with computers and networks as audio playback environments. In particular, with the advent of optical disks for program storage and distribution, it became apparent that audio playback capability based on compact disks could easily be added to desktop computers.

Those using optical disk drives incorporated in desktop computers as audio playback devices quickly realized the limitations of the hardware. Early optical disk drives were expensive, and whenever an optical disk needed to be read or written for productivity purposes, it required that an audio disk (if in use) to be removed from the optical disk drive. In order to overcome this limitation, it was realized that audio content could be stored on a hard drive. No longer would it be necessary to interrupt audio playback while performing productivity operations that required use of an optical drive. However, those familiar with the situation realized that current hard drives were not practical as media for storing audio encoded at the bit rate reflected in the compact disk format.

Conventional compact disks encoding audio information typically store anywhere from 300 to 700 mbytes of information. Hard drives available in the mid- to late-1990s were simply of too-limited capacity to store significant amounts of audio information encoded in the compact disk format, especially when those interested in doing so realized that a desktop computer could be used as a "jukebox". In order to overcome this limitation, it became apparent that new encoding formats needed to be developed that would result in a significant decrease in file sizes.

The MP3 format was developed to accomplish this. During development of the MP3 encoding format, it was realized that in a passage of music, certain elements occurring in close proximity time-wise to other elements would mask those other elements from a human listener. Once this phenomenon of human hearing was recognized, those seeking greater compression of audio information realized that lossy encoding formats could be adopted. Such lossy formats would save file space by not encoding information associated with content that was effectively masked to human listeners. Resulting lossy formats, like the MP3 standard, achieve a many-fold or more decrease in file size while maintaining reasonable audio quality.

The situation has changed, though, with the advent of terabyte hard drives and wide-band wired and wireless communications networks. Particularly with respect to desktop computers, it is no longer necessary to employ lossy audio encoding formats since a large-capacity hard drive can easily accommodate all of a user's compact disks with room left over, even if the user's disk collection extends to hundreds of compact disks. Thus, lossless encoding capability has been added to well-known music management and playback software packages.

A frequent complaint heard concerning on-line music stores is that music content is available only in lossy, low bit-rate formats. In view of the fact that many users have access to wideband network connections, those users demand access to higher-quality encoding formats, up to and including lossless encoding formats. Alternatively, users may not always desire higher-quality music associated with high bitrates. For instance, portable music players typically have much-smaller hard drives when compared to desktop computers. In such instances, it becomes necessary to transcode a music collection encoded at a high bit rate to a low bitrate if the music collection is to "fit" on the hard drive of the portable music player.

In addition, transmission of high-quality audio content occurs in some situations over a package-switched network that does not provide perfect quality of service. In such situations, it can be expected that packets encoding audio information will be dropped. In other content distribution situations, users may have playback devices with varying capability, or users may desire varying levels of audio fidelity. In such situations, it would be impractical to provide each user with bitstreams of audio content at the user's desired bit rate.

To accommodate these varying playback environments, scalable methods of encoding audio information have been developed. Such methods encode information at high bit rates, but permit the audio information to be decoded at lower bit rates. For example, audio content encoded in a lossless format can be decoded in lossy formats at varying rates like 128 kbit/s; 96 kbit/s; 64 kbit/s or 32 kbit/s. Such an approach is highly efficient. Although large-capacity hard drives have become available, it would still be economically inefficient to store multiple copies of an audio file at different bit rates. Instead, it is far more efficient to encode an audio file in an encoding format that supports fine-grain bitrate scalability, enabling, e.g., the transmission of a single bitstream that may be decoded ay many varying rates.

Concurrently with these developments, the search for more efficient codecs for encoding audio information continues. Once such encoding method creates compressed audio data using companding and vector quantization of frequency domain coefficients representing the audio data. This method has proved advantageous in comparison to other encoding methods.

In view of the advantages of compression methods using companding and vector quantization, those skilled in the art seek to expand the usefulness of these methods by combining them with scalable encoding methods.

SUMMARY OF THE PREFERRED EMBODIMENTS

The foregoing and other problems are overcome, and other advantages are realized, in accordance with the following embodiments of the invention.

A first embodiment of the invention comprises a method comprising: performing a time domain to discrete frequency domain transformation on an audio signal, generating a plurality of spectral coefficients for each of a plurality of subbands; scaling, companding and vector quantizing the spectral coefficients for each of the plurality of subbands on a subband basis to generate modified spectral coefficients; generating side information for each of the plurality of subbands; bitplane encoding the modified spectral coefficients on a subband basis using a plurality of bitplane levels, the modified spectral coefficients bitplane encoded in descending order of importance; and combining the side information and the bitplane encoded modified spectral coefficients into a scalable bitstream from which the audio signal can be recovered at a scalable rate.

A variant of the first embodiment further comprises receiving the scalable bitstream; receiving a selected decode bitrate; recovering the side information from the scalable bitstream; selecting sufficient bits encoding the modified spectral coefficients from the scalable bitstream so that the audio signal may be recovered from the scalable bitstream at the selected decode bitrate; recovering the modified spectral coefficients using the side information to obtain the order of significance of the subbands; decompanding the modified spectral coefficients on a subband basis using the selected bits at a fidelity level corresponding to the selected decode bitrate; scaling the decompanded modified spectral coefficients on a subband basis at the fidelity level corresponding to the selected decode bitrate; and performing a discrete frequency domain to time domain transform on the decompanded and scaled modified spectral coefficients to reproduce a version of the audio signal at the fidelity level corresponding to the selected decode bitrate.

A second embodiment of the invention comprises a method for audio encoding comprising: receiving an input audio signal; performing a time-domain to discrete frequency domain transformation on the input audio signal, the time-domain to discrete frequency domain transformation creating a plurality of frequency domain coefficients; and organizing the frequency domain coefficients by frequency subband. Then, for each subband the following operations are performed: scaling the frequency domain coefficients with a first scaling factor, wherein the first scaling factor comprises a first scaling factor base and a first scaling factor exponent; companding the frequency domain coefficients, wherein the scaled and companded frequency domain coefficients comprise a subband coefficient vector; vector quantizing the subband coefficient vector; determining a maximum norm of the quantized subband coefficient vector; and encoding the first scaling factor exponent and the maximum norm of the quantized subband coefficient vector, the first scaling factor exponent and the maximum norm of the quantized subband coefficient vector comprising side information for the subband. After the preceding operations are performed for each subband, the following operations are performed: bitplane encoding the subband coefficients comprising the subband coefficient vectors on a subband basis using a plurality of bitplane levels, the subband coefficients bitplane encoded in descending order of importance, the order of importance derived from the side information; and combining the subband side information and bitplane encoded subband coefficients into a scalable bitstream from which the audio signal can be recovered at a scalable rate.

A third embodiment of the invention comprises an encoder comprising: a transform unit adapted to perform a time domain to discrete frequency domain transformation on an audio signal, generating a plurality of spectral coefficients for each of a plurality of subbands; a scaling unit adapted to scale the spectral coefficients; a companding unit adapted to compand the spectral coefficients; a quantizing unit adapted to vector quantize the spectral coefficients on a subband basis, the scaling, companding and quantizing units together generating modified spectral coefficients; a side information generating unit adapted to generate side information for each of the plurality of subbands; and a bitplane encoding unit adapted to bitplane encode the modified spectral coefficients on a subband basis using a plurality of bitplane levels, the modified spectral coefficients bitplane encoded in descending order of importance; the bitplane encoding unit further adapted to combine the side information with the bitplane encoded modified spectral coefficients to form a scalable bitstream from which the audio signal can be recovered at a scalable rate.

A fourth embodiment of the invention comprises an electronic device comprising: a transform unit adapted to receive an input audio signal, to perform a time-domain to discrete frequency domain transformation, the time domain to discrete frequency domain transformation creating a plurality of frequency domain coefficients, and to organize the frequency domain coefficients by frequency subband; a scaling unit adapted to scale frequency domain coefficients associated with each subband with a first scaling factor, wherein the first scaling factor comprises a first scaling factor base and a first scaling factor exponent, and wherein a first scaling factor for one of the subbands may differ from a first scaling factor for other subbands; a companding unit adapted to compand the scaled frequency domain coefficients associated with each subband, wherein the scaled and companded frequency domain coefficients comprise scaled, companded subband coefficient vectors; a quantizing unit adapted to vector quantize the scaled, companded subband coefficient vectors; a side information unit adapted to encode side information for each subband, the side information comprising the first scaling factor exponent associated with the scaling factor applied to the subband, and a maximum norm of the quantized subband coefficient vector associated with the subband; and a bitplane encoding unit adapted to bitplane encode using a plurality of bitplane levels the subband coefficients comprising the vector quantized, companded and scaled subband coefficient vectors, the bitplane encoding unit further adapted to generate a scalable bitstream by combining the bitplane encoded subband coefficients and the side information.

A fifth embodiment of the invention comprises a tangible memory medium storing a computer program executable by a digital processing apparatus of an electronic device, wherein when the computer program is executed operations are performed, the operations comprising: receiving an input audio signal; performing a time-domain to discrete frequency domain transformation, the time domain to discrete frequency domain transformation creating a plurality of frequency domain coefficients; and organizing the frequency domain coefficients by frequency subband. Then for each subband the following operations are performed: scaling the frequency domain coefficients with a first scaling factor, wherein the first scaling factor comprises a first scaling factor base and a first scaling factor exponent; companding the frequency domain coefficients, wherein the scaled and companded frequency domain coefficients comprise a subband coefficient vector; vector quantizing the subband coefficient vector; determining a maximum norm of the quantized subband coefficient vector; encoding the first scaling factor exponent and the maximum norm of the quantized subband coefficient vector, the first scaling factor exponent and the maximum norm of the quantized subband coefficient vector comprising side information for the subband. After the preceding operations are performed for each subband, the following operation is performed: bitplane encoding the subband coefficients using a plurality of bitplane levels, creating an embedded scalable bit stream.

A sixth embodiment of the invention comprises a decoder comprising: a side information unit adapted to recover subband side information from a scalable bitstream comprised of bitplane-encoded modified spectral coefficients and the subband side information, the bitplane-encoded modified spectral coefficients encoding an audio signal recoverable at a scalable bitrate, the modified spectral coefficients modified as a result of scaling, companding and vector quantizing operations performed by an encoder; a bitplane decoding unit adapted to receive a selected decode bitrate, the side information and the scalable bitstream; to select sufficient bits encoding the modified spectral coefficients on a bitplane level basis from the scalable bitstream so that the audio signal may be reproduced at a fidelity level corresponding to the selected decode bitrate; and to recover the modified spectral coefficients using the side information for the subbands order of significance; a decompanding unit adapted to decompand the modified spectral coefficients on a subband basis at the fidelity level corresponding to the selected decode bitrate using the bits selected by the bitplane decoding unit; a scaling unit adapted to scale the decompanded modified spectral coefficients on a subband basis at the fidelity level corresponding to the selected decode bitrate; and a transform unit adapted to perform a discrete frequency domain to time domain transform on the ordered, scaled and decompanded modified spectral coefficients to reproduce a version of the audio signal at the fidelity level corresponding to the selected decode bitrate.

In conclusion, the foregoing summary of the embodiments of the present invention is exemplary and non-limiting. For example, one of ordinary skill in the art will understand that one or more aspects or steps from one embodiment can be combined with one or more aspects or steps from another embodiment to create a new embodiment within the scope of the present invention.

BRIEF DESCRIPTION OF THE DRAWINGS

The foregoing and other aspects of these teachings are made more evident in the following Detailed Description of the Preferred Embodiments, when read in conjunction with the attached Drawing Figures, wherein.

DETAILED DESCRIPTION OF THE PREFERRED EMBODIMENTS

The present invention realizes a scalable version of an audio coder based on lattice quantization of companded data. One method to realize a scalable bitstream is the use of bitplane encoding of some coefficients and it consists in sequentially taking the bits of the considered coefficients starting with the most significant bit down to the least significant bit. Thus, if only part of the bitstream is received at the decoder side, at least some approximations issuing from the most significant bits are recovered. The main challenges of the method reside in choosing the non-scalable method to start with, and within it, the coefficients that are to be scaled as well as the order in which the coefficients are considered. The scalable approach of the present invention starts from an encoded version of the audio sample generated using companding and vector quantization, and represents it in a scalable embedded bitstream.

Figure 1:
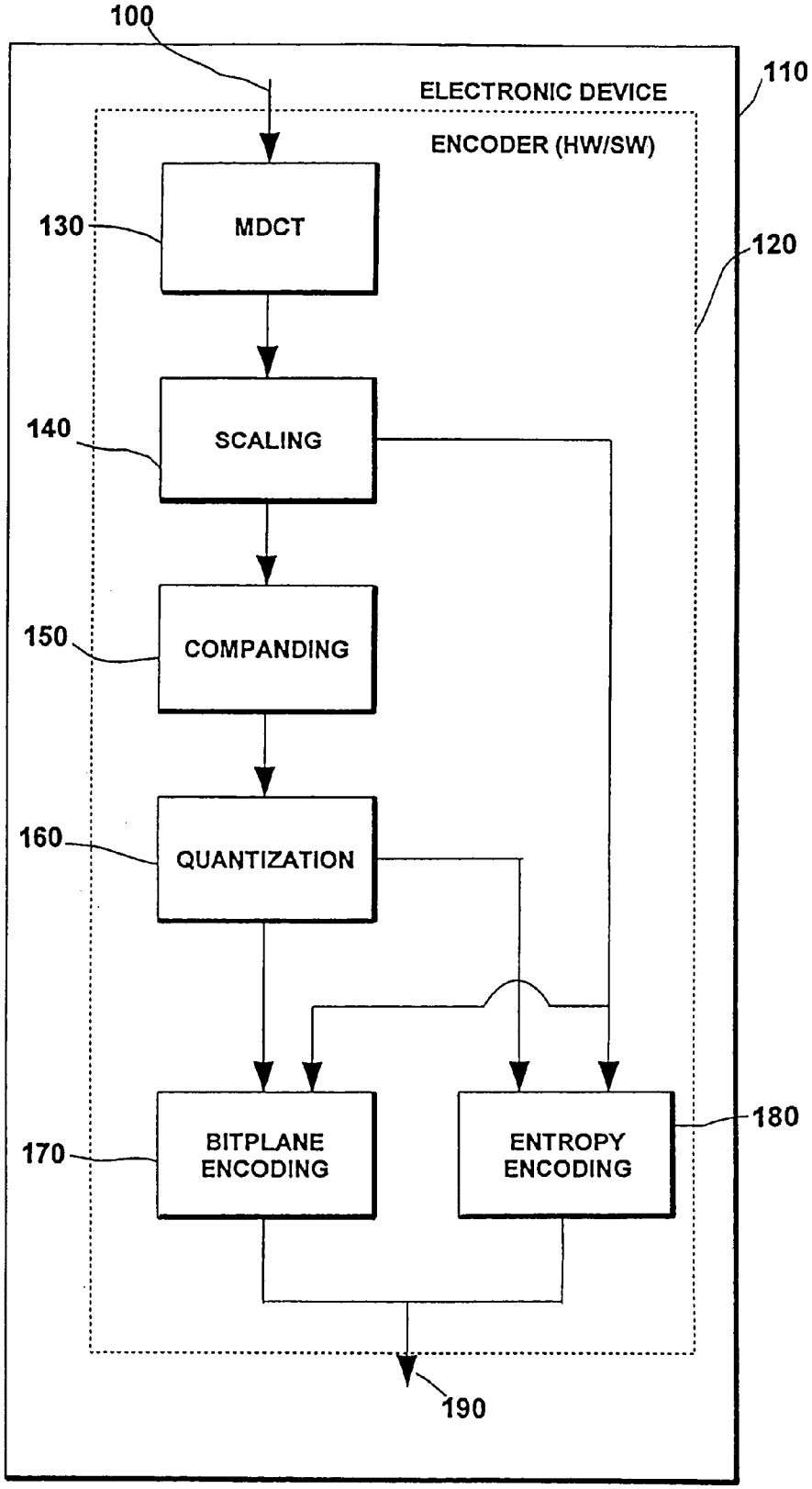
FIG. 1 is a block diagram depicting an electronic device capable of performing encoding operations in accordance with the invention.

The methods of the present invention may be practiced in an electronic device 110 like that depicted in FIG. 1. The electronic device 110 comprises an encoder 120, which may be implemented in hardware or software. When operating, the encoder 120 receives an audio signal 100. A time-domain to discrete frequency domain transformation is performed by MDCT unit 130, which uses a modified-discrete cosine transform. The MDCT unit 130 generates a plurality of frequency domain coefficients, which are organized by subband. The coefficients for each subband are scaled by scaling unit 140; companded by companding unit 150; and vector quantized by quantization unit 160. Entropy encoding unit 180 encodes side information for each subband as will be described in greater detail in the following description. The resulting scaled, companded and quantized frequency domain coefficients are then bitplane encoded by bitplane encoding unit 170, creating an embedded scalable bitstream 190.

An encoder using companding and vector quantization but not capable of generating an embedded scalable bitstream differs somewhat from that depicted in FIG. 1. Similar to that depicted in FIG. 1, the spectral MDCT coefficients are encoded subband-wise by vector quantizing the scaled and companded subband coefficient vector for each subband. The vector quantization is realized using a $Z_n$ lattice, where n is the dimension of the subband. As side information the exponent of the scaling factor for each subband, and the maximum absolute value of the subband quantized vector are entropy encoded. The maximum absolute value, i.e. the maximum norm of the subband codevector, is used to calculate the number of bits on which the index of the subband codevector is represented. The base of the scaling factor is 1.45 for overall bitrates higher than 48 kbits/s and 2.0 for overall bitrates lower than 48 kbits/s. The encoded information consists of the side information and the indexes of the codevectors for each subband.

The non-scalable encoding method cannot be, as such, a base for a bitplane scalable approach, because bitplanes of the codevector indexes have no significance. Therefore, in the invention indexing of the codevectors is dropped and the scalable approach is implemented in the coefficients' domain. The values of the scaled quantized coefficients are not relevant to the real value of the coefficients, due to the different scale values that are applied to different subbands. The side information is therefore compulsory, considered as a baseline to the scalable approach. For each subband, the maximum number of bits per coefficient, $nb_i$, can be calculated from the side information:

$$\lceil s_1 \log_2 b + \log_2 C^{-1}(nrm_i) \rceil + 1$$

where $s_i$ is the exponent of the scaling factor for the subband i, b is the base of the scaling factor, $nrm_i$ is the maximum norm of the subband i, and $C^{-1}$ is the inverse of the companding function. A bit for the sign is also considered.

The maximum number of bits per coefficient for each subband gives the importance of each subband, meaning that the subbands are considered within the bitplane approach in the order of their importance, starting from the most important. Since the importance of the subband is derived from the compulsory side information there is no need to send additional information relative to the order in which the subbands are considered. The scalable bitplane approach, for each frame, at a given bitplane level, proceeds as described in the following algorithm:

```
For each sub-band
  If the sub-band is "important"
    For each coefficient
      If the coefficient is significant at the given level
        If the coefficient is considered for the first time
          Add a bit for its sign
          Add its MSB
        Else
          Add the current bitplane level bit of the
            coefficient
        End If
      Else
        Add a zero bit
      End If
    End For
  End If
End For
```

The resulting scalable bitstream can optionally be entropy encoded.

Figure 2:
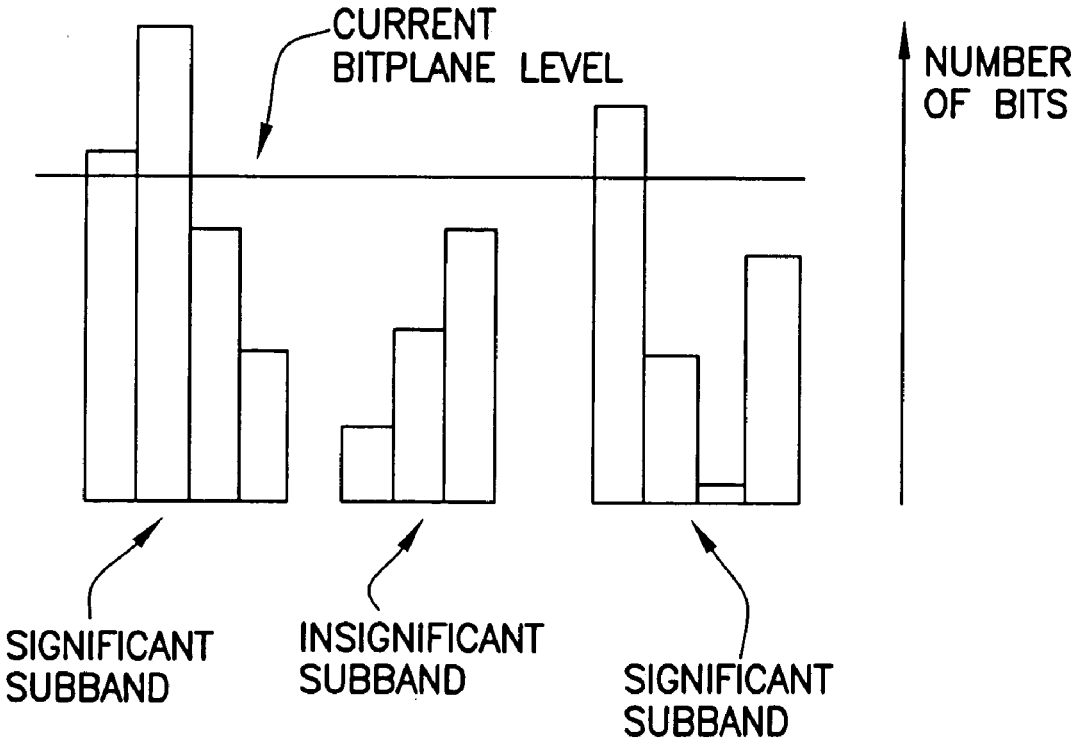
FIG. 2 is a graph indicating how bitplane encoding is performed at a particular bitplane level in methods of the invention.

FIG. 2 illustrates an example of significant and non-significant subbands. The corresponding bitstream at the current bitplane level would be: "sxx00xx000" where "s" stands for the sign bit, and "x" the value of the bit of the significant bit. Remark that for the coefficients that are first time significant, two bits are output: the sign bit and the most significant bit.

The information embedded in the bitstream comprises at least two types of information: the value of the bits from the significant coefficients and the position of the significant coefficients. The information relative to the position of the significant coefficients can be more efficiently packed if more coefficients are considered at a time as presented in the following section.

For the sub-bands having a higher number of coefficients it becomes efficient to encode the position of the significant coefficients at a given bitplane level by indexing of the binomial coefficient corresponding to it. Since the bitplane level starts from the most significant bit downward, the coefficient that has been significant at a given level will remain significant at the next levels. This implies that, actually only the position of the new significant coefficients at each level needs to be encoded. However, the number of new significant coefficients per subband, for each bitplane level has to be encoded separately. The encoding procedure is schematized in the following algorithm:

```
For each sub-band
  If the sub-band is "important"
    For each coefficient
      If the coefficient is significant at the given level
        If the coefficient is considered for the first time
          Save the position of the coefficient
            within the sub-band
          Add to a temporary buffer a bit for its
            sign
          Add to a temporary buffer its MSB
        Else
          Add to a temporary buffer the current
            bitplane level bit of the coefficient
        End If
      End If
    End For
    Write the position index of the first time significant coefficients
      in the bitstream
  Write the temporary buffer to the bitstream
End If
```

For a sub-band of length n, for which k coefficients have already been significant at the previous bitplane level and l coefficients are significant for the first time at the current bitplane level, the number of bits on which the position index is represented is $$\left\lceil \log_2 \binom{n-k-l}{l} \right\rceil$$

An algorithm is used to enumerate the number of ways l identical objects can be put on n-k-l positions to calculate the position index.

The method using indexing of significant coefficient positions brings a gain only for higher dimensional subbands and it has been used only for subbands having a dimension higher or equal to 28. To counter sub-optimal performance for lower dimensional sub-bands, several sub-bands can be grouped together. A total group size of approximately 32 was adopted. The sub-bands have been grouped as follows:

TABLE 1

Grouping of Subbands

| Sub-bands | Number of coefficients |
|---|---|
| 1-8 | 8 × 4 = 32 |
| 9-13 | 2 × 4 + 3 × 8 = 32 |
| 14-17 | 4 × 8 = 32 |
| 18-19 | 2 × 12 = 24 |
| 20-21 | 2 × 12 = 24 |
| 22-23 | 2 × 16 = 32 |

The sub-bands corresponding to higher frequencies have already dimension 32, so there is no need of grouping.

The importance of sub-bands is given, like in the previous method by the number of bits on which the sub-band coefficients are estimated to be represented. When indexing the positions within a group, the dimensions of subbands that are not yet significant are subtracted from the overall dimension of the group.

If the number of bits on which the spectral coefficients are represented is the same as in the previous frame, the information relative to the significant coefficients is no longer needed. The use of this type of inter-frame prediction means the addition of a bit per frame to the signal if the number of bits for each coefficient is preserved relative to the previous frame. For reasons related to random access points, an infinite prediction may not be allowed; therefore restrictions to the length of the prediction history were considered, allowing random access points at every 500 ms.

The use of the real maximum number on which the coefficients are represented as an indicator of the significance of a subband, especially for the encoded versions issued only from the first bitplanes gives rise to auditory artifacts due to holes in the spectrum. Since the initial bitstream is encoded at a high bitrate, higher subbands are present and they may become significant before some of the lower subbands. Perceptually, the low pass effect may be more acceptable. Two approaches have been considered. In the first one the importance indicator is weighted by a power low factor such that much emphasis is given to the lower frequencies band. The weighting factor is unitary for frequencies up to 2750 Hz and sub-unitary for higher frequencies. In the second approach the importance indicators for the lower frequencies are preserved, but for higher frequencies it is decreased such that no higher frequency is considered before all the spectral coefficients from the lower subbands become significant (if they are non-zero). The importance of the higher subbands is set artificially to be decreasing by one such that at each bitplane level only one subband becomes significant at a time. This allows for the side information consisting of subband norms and exponent of scale factors for the higher frequency subbands to be sent gradually, which would not be possible for the first approach since the importance of the subbands is derived solely from the side information.

Before testing the quality of the scalable encoded versions at different bitrates, it was also considered if the original non-scalable bitstream corresponding for instance to encoding bitrates of 48 kbits/s or 64 kbits/s are more efficiently encoded in the scalable bitstream. Table 2 presents the bitrate reduction in percentage from the non-scalable versions encoded at 64 kbits/s and 48 kbits/s respectively. The position indexing for the higher subbands is used; there are no restrictions on the prediction and the bitstream is additionally entropy encoded. The reduction is on average, for the considered set of audio files, 15% when the non-scalable bitstream is at 64 kbits/s and 26% when the non-scalable bitstream is at 48 kbits/s.

Table 3 presents similar results when subband grouping is used for the position encoding of the significant coefficients. From informal listening tests, it can be observed that the grouping of the subbands is beneficial with respect to the efficiency of the method when the scalable bitrates are close to the initial bitrate. The use of the additional arithmetic coding does not bring an important improvement as concluded through the comparison of the results from Table 3 and Table 4.

Nevertheless, much of the gain introduced by the scalable method comes from the use of prediction as observed when comparing Table 2 and Table 5 which present results issued from using the position indexing for higher subbands, with and without prediction respectively. The effect of restricting the prediction to every other frame is depicted from Table 6 and, furthermore, if the prediction is allowed only within blocks of 20 frames most of the advantages brought by the infinite prediction can be regained as illustrated in Table 7.

TABLE 2

Index of positions for subbands starting with subband 26, infinite prediction, arithmetic encoding (AC) of the resulting bitstream.

| File | Bitrate equivalent to 64 kbits | % reduction | Bitrate equivalent to 48 kbits | % reduction |
|---|---|---|---|---|
| es01 | 59484 | 7.06 | 41086 | 14.40 |
| es02 | 60196 | 5.94 | 40520 | 15.58 |
| es03 | 60502 | 5.47 | 40618 | 15.38 |
| sc01 | 54911 | 14.20 | 35934 | 25.14 |
| sc02 | 56435 | 11.82 | 37381 | 22.12 |
| sc03 | 54511 | 14.83 | 34000 | 29.17 |
| si01 | 49798 | 22.19 | 30692 | 36.06 |
| si02 | 61291 | 4.23 | 41277 | 14.01 |
| si03 | 45451 | 28.98 | 27772 | 42.14 |
| sm01 | 41365 | 35.37 | 28795 | 40.01 |
| sm02 | 56210 | 12.17 | 34350 | 28.44 |
| sm03 | 50982 | 20.34 | 32727 | 31.82 |
| | Average | 15.22 | | 26.19 |

TABLE 3

Group subbands, prediction with no restrictions, AC coding of embedded bitstream

| File | Bitrate equivalent to 64 kbits | % reduction | Bitrate equivalent to 48 kbits | % reduction |
|---|---|---|---|---|
| es01 | 56003 | 12.50 | 38177 | 20.46 |
| es02 | 56715 | 11.38 | 36929 | 23.06 |
| es03 | 57413 | 10.29 | 37229 | 22.44 |
| sc01 | 50384 | 21.28 | 31067 | 35.28 |
| sc02 | 53775 | 15.98 | 36137 | 24.71 |
| sc03 | 51725 | 19.18 | 31523 | 34.33 |
| si01 | 47724 | 25.43 | 27275 | 43.18 |
| si02 | 58193 | 9.07 | 37925 | 20.99 |
| si03 | 44260 | 30.84 | 25399 | 47.09 |
| sm01 | 41829 | 34.64 | 28957 | 39.67 |
| sm02 | 51958 | 18.82 | 28020 | 41.63 |
| sm03 | 49219 | 23.10 | 30934 | 35.55 |
| | Average | 19.38 | | 32.37 |

TABLE 4

Group subbands, prediction with no restrictions, no arithmetic encoding

| File | Bitrate equivalent to 64 kbits | % reduction | Bitrate equivalent to 48 kbits | % reduction |
|---|---|---|---|---|
| es01 | 57578 | 10.03 | 39190 | 18.35 |
| es02 | 58196 | 9.07 | 37715 | 21.43 |
| es03 | 58926 | 7.93 | 38014 | 20.80 |
| sc01 | 51920 | 18.88 | 31965 | 33.41 |
| sc02 | 55272 | 13.64 | 37122 | 22.66 |
| sc03 | 53188 | 16.89 | 32378 | 32.55 |
| si01 | 49444 | 22.74 | 28130 | 41.40 |
| si02 | 59849 | 6.49 | 38888 | 18.98 |
| si03 | 46136 | 27.91 | 26510 | 44.77 |
| sm01 | 43679 | 31.75 | 30385 | 36.70 |
| sm02 | 53877 | 15.82 | 28846 | 39.90 |
| sm03 | 50721 | 20.75 | 31835 | 33.68 |
| | Average | 16.82 | | 30.39 |

TABLE 5

| File | Bitrate equivalent to 64 kbits | % reduction | Bitrate equivalent to 48 kbits | % reduction |
|---|---|---|---|---|
| Index of positions for subbands starting with subband 26 with AC, no prediction. | | | | |
| es01 | 67166 | −4.95 | 49097 | −2.29 |
| es02 | 67555 | −5.55 | 49290 | −2.69 |
| es03 | 67555 | −5.55 | 49078 | −2.25 |
| sc01 | 64167 | −0.26 | 46184 | 3.78 |
| sc02 | 64955 | −1.49 | 45902 | 4.37 |
| sc03 | 62993 | 1.57 | 44180 | 7.96 |
| si01 | 58742 | 8.22 | 41411 | 13.73 |
| si02 | 68498 | −7.03 | 50138 | −4.45 |
| si03 | 53686 | 16.12 | 36882 | 23.16 |
| sm01 | 49884 | 22.06 | 35647 | 25.74 |
| sm02 | 64295 | −0.46 | 45992 | 4.18 |
| sm03 | 59727 | 6.68 | 42043 | 12.41 |
| | Average | 2.44 | | 6.97 |

TABLE 6

| File | Bitrate equivalent to 64 kbits | % reduction | Bitrate equivalent to 48 kbits | % reduction |
|---|---|---|---|---|
| Prediction at every 2nd frame, AC coding of embedded bitstream | | | | |
| es01 | 65032 | −1.61 | 46480 | 3.17 |
| es02 | 65547 | −2.42 | 46162 | 3.83 |
| es03 | 65836 | −2.87 | 46062 | 4.04 |
| sc01 | 60743 | 5.09 | 41464 | 13.62 |
| sc02 | 62803 | 1.87 | 43867 | 8.61 |
| sc03 | 60597 | 5.32 | 40607 | 15.40 |
| si01 | 56191 | 12.20 | 36935 | 23.05 |
| si02 | 66992 | −4.68 | 47234 | 1.60 |
| si03 | 51506 | 19.52 | 33190 | 30.85 |
| sm01 | 48382 | 24.40 | 34285 | 28.57 |
| sm02 | 61170 | 4.42 | 39681 | 17.33 |
| sm03 | 57699 | 9.85 | 39234 | 18.26 |
| | Average | 5.92 | | 14.03 |

TABLE 7

| File | Bitrate equivalent to 64 kbits | % reduction | Bitrate equivalent to 48 kbits | % reduction |
|---|---|---|---|---|
| Prediction at every 20th frame, AC coding of embedded bitstream | | | | |
| es01 | 56921 | 11.06 | 39045 | 18.66 |
| es02 | 57637 | 9.94 | 37925 | 20.99 |
| es03 | 58264 | 8.96 | 38088 | 20.65 |
| sc01 | 51439 | 19.63 | 32131 | 33.06 |
| sc02 | 54707 | 14.52 | 36985 | 22.95 |
| sc03 | 52641 | 17.75 | 32471 | 32.35 |
| si01 | 48574 | 24.10 | 28278 | 41.09 |
| si02 | 59096 | 7.66 | 38809 | 19.15 |
| si03 | 44997 | 29.69 | 26189 | 45.44 |
| sm01 | 42483 | 33.62 | 29477 | 38.59 |
| sm02 | 52916 | 17.32 | 29223 | 39.12 |
| sm03 | 50138 | 21.66 | 31846 | 33.65 |
| | Average | 17.99 | | 30.47 |

Figure 3:
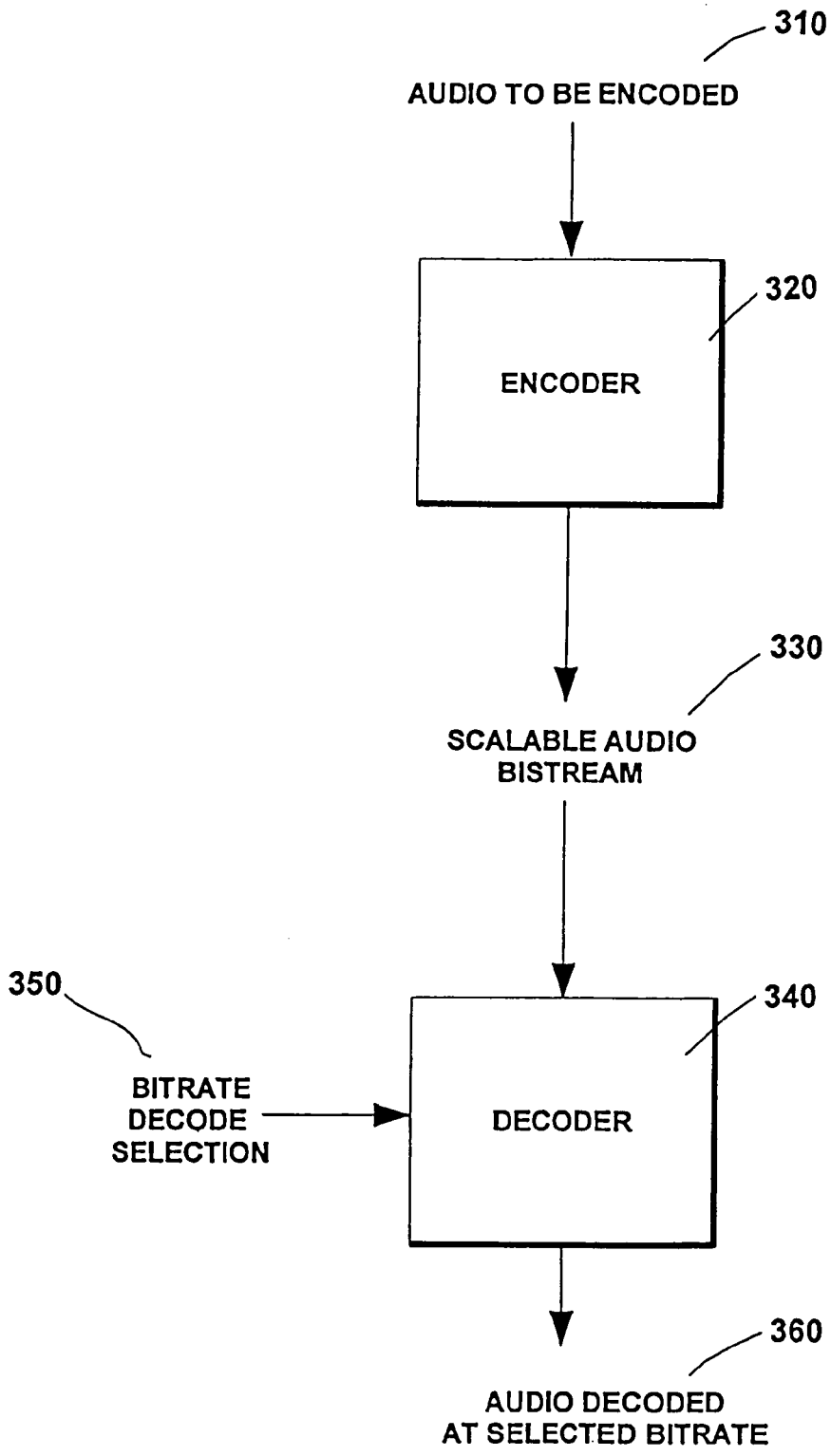
FIG. 3 is a block diagram depicting a system operating in accordance with the invention where encoding and decoding operations are performed.

FIG. 3 is a block diagram depicting a system operating in accordance with the invention. In the system, audio to be encoded 310 is provided to encoder 320. Encoder 320 is configured to operate like encoder 120 depicted in, and described with reference to, FIG. 1. Encoder 320 generates a scalable bitstream 330 encoding the audio 310 provide to the encoder 320. The scalable bitstream 330 is then transmitted to an electronic device incorporating decoder 340. Decoder 340 receives a selection of the bitrate 350 to be used in decoding the scalable audio bitstream from, for example, a user of the electronic device incorporating the decoder. Alternatively, the electronic device incorporating the decoder may be programmed to decode the scalable bitstream at a pre-determined bitrate. The decoder 340 decodes the audio information at the selected bitrate 350 generally by performing the inverse operations of those depicted in FIG. 1.

Figure 4:
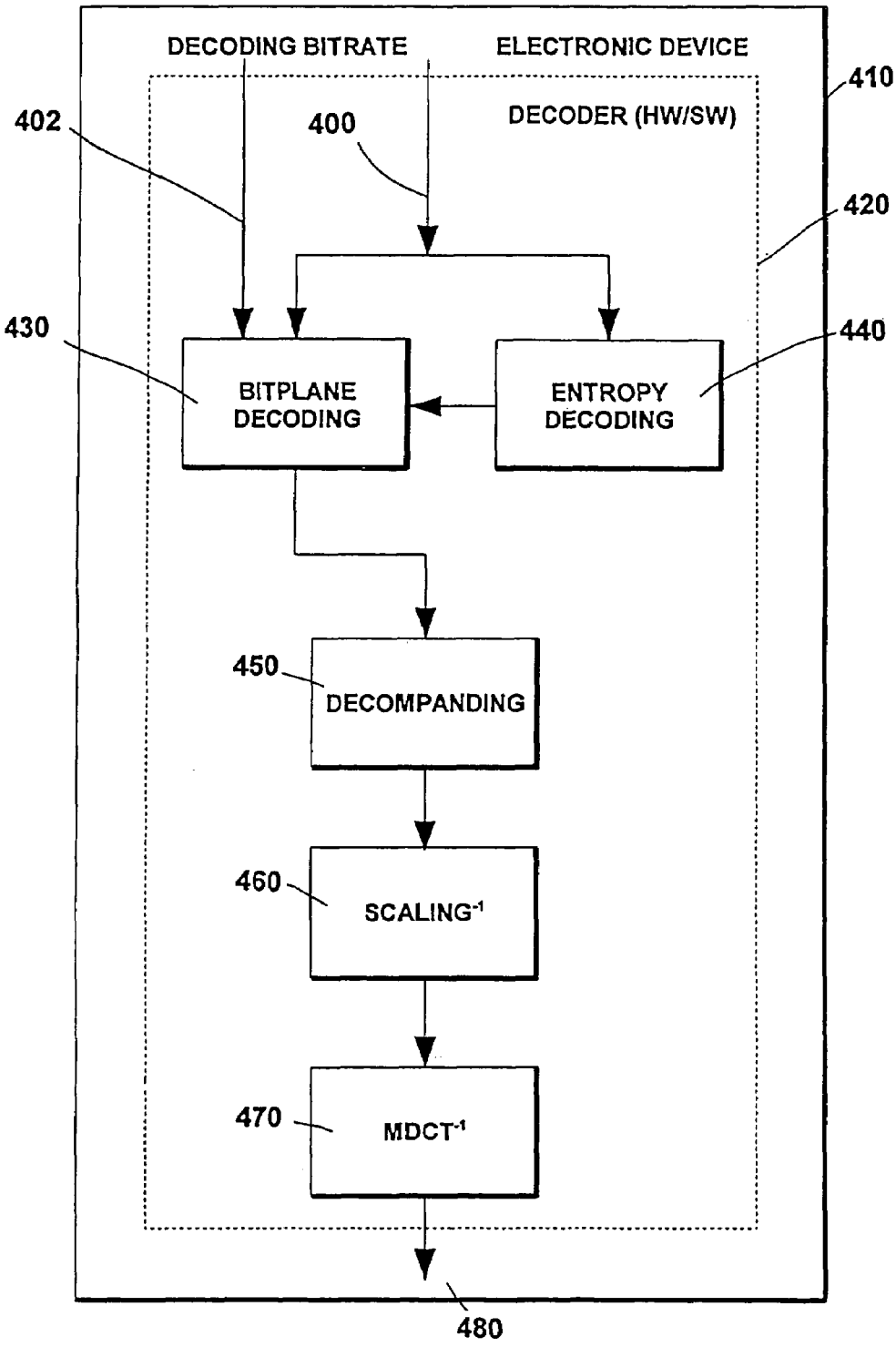
FIG. 4 is a block diagram depicting an electronic device capable of performing decoding operations in accordance with the invention.

FIG. 4 depicts an electronic device 410 incorporating a decoder 420 capable of performing operations like decoder 340 depicted in FIG. 3. Decoder 420 receives an embedded scalable bitstream 400 like that generated by encoder 320 in FIG. 3. The embedded scalable bitstream encodes an audio signal subband-wise. As described previously, a time-domain to discrete frequency domain transform is performed on the audio signal. The subband spectral coefficients are organized subband-wise; scaled; companded and quantized. The resulting scaled, companded and quantized subband spectral coefficients are then bitplane encoded, starting with subbands containing coefficients significant at a selected bitplane level and continuing for each bitplane level until bits have been generated for all bitplane levels. At the same time, side information is generated for each subband. The resulting embedded scalable bitstream can be recovered at variable bitrates.

A bitplane decoding unit 430 depicted in FIG. 4 receives the embedded scalable bitstream, the entropy decoded information from the entropy decoding unit 440, and a selected decoding bitrate 402. The decoding bitrate 402 may be selected by a user of electronic device 410, or may be predetermined for electronic device 420. Alternatively, electronic device 420 may adaptively select the decoding bitrate depending on conditions impacting the transmission medium over which the embedded scalable bitstream is transmitted. The bitplane decoding unit 430 selects sufficient bits from the embedded scalable bitstream so that the audio signal can be reproduced at the selected bitrate. The bits are selected in descending order from bitplane levels encoding values for most significant subband spectral coefficients to bitplane levels encoding values for least significant subband spectral coefficients. The number of bits actually selected depends on the selected decode bitrate; anytime less than highest possible decoding bitrate is selected for decoding purposes, certain bits will be ignored for decoding purposes. The bits selected by bitplane decoding unit 430 and side information recovered by entropy decoding unit 440 are used to assemble approximations of the subband coefficient vectors at a fidelity corresponding to the desired decode bitrate. Decompanding unit performs decompanding operations on the effective subband coefficient vectors which were companded during the encoding process. The decompanded effective subband coefficient vectors are then scaled using the side information recovered by the entropy decoding unit 440. Then, an inverse transform unit 470 performs a discrete frequency domain to time domain transform on the decompanded and scaled effective subband coefficient vectors to generate a representation of the encoded audio signal at the selected bitrate.

Figure 5:
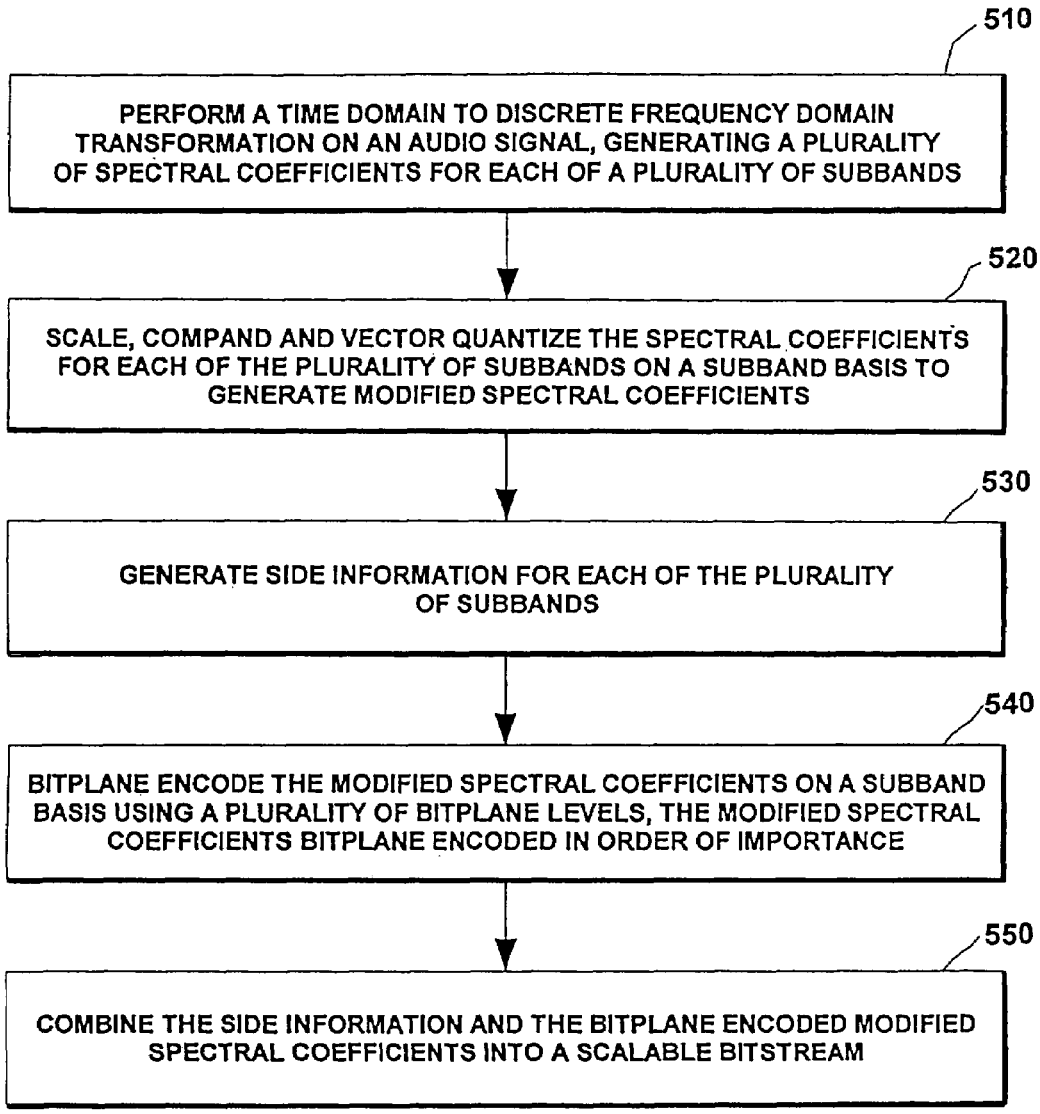
FIG. 5 is a flowchart depicting a method operating in accordance with the invention.
Figure 6:
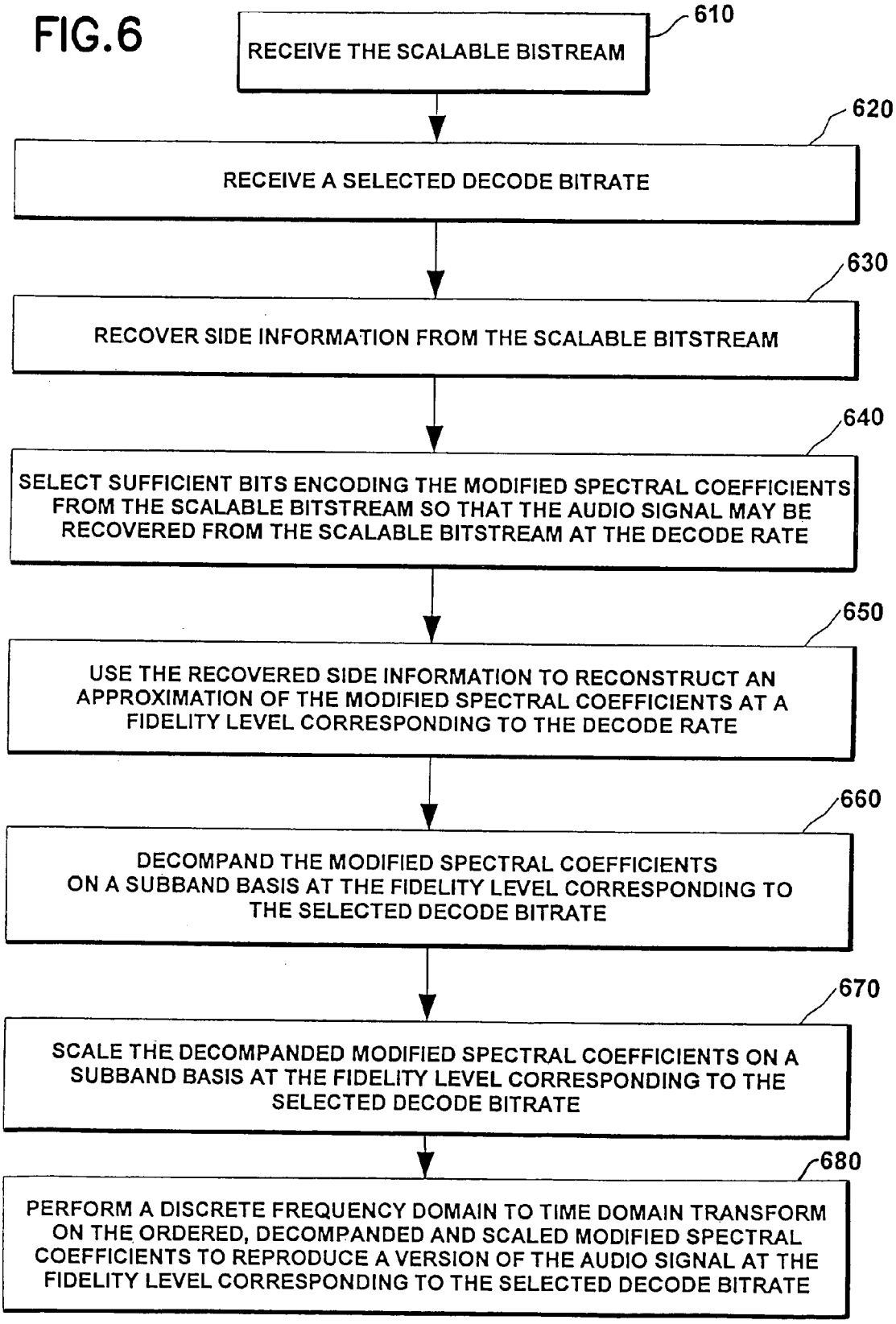
FIG. 6 is a flowchart depicting a method operating in accordance with the invention.

FIGS. 5 and 6 summarize in a more general manner the encoding and decoding methods comprising aspects of the invention. At 510, an encoder performs a time domain to discrete frequency domain transformation on an audio signal, generating a plurality of spectral coefficients for each of a plurality of subbands. Then, at 520, the encoder scales, compands and vector quantizes the spectral coefficients for each of the plurality of subbands on a subband basis to generate modified spectral coefficients. "Modified" refers to the effect of the scaling, companding and vector quantizing operations on the spectral coefficients. Then, at 530, the encoder generates side information for each of the plurality of subbands.

The side information, in one variant of the method depicted in FIG. 5, comprises an exponent of a scaling factor applied by the encoder to the subband coefficients for a particular subband, and the maximum norm of the quantized subband coefficients for that particular subband. Next, at 540, the encoder bitplane encodes the modified spectral coefficients on a subband basis using a plurality of bitplane levels The importance of a subband is derived from its maximum norm and scale factor and the subbands are ordered accordingly. The importance of a coefficient within a subband is given by the coefficient values and it is encoded implicitly in the bitplane encoded bitstream. Then, at step 550, the encoder combines the side information and the bitplane encoded modified spectral coefficients into a scalable bitstream.

FIG. 6 is a flowchart depicting decoding operations performed in accordance with the invention. At step 610, a decoder receives a scalable bitstream generated by, for example, a method operating in accordance with the method depicted in FIG. 5. At step 620, the decoder receives a selected decode bitrate. The selected decode bitrate corresponds to the decode bitrate at which the audio signal encoded in the scalable bitstream will be recovered. Next, at step 630, the decoder recovers the subband side information from the scalable bitstream. Then, at step 640, the decoder selects sufficient bits encoding the modified spectral coefficients from the scalable bitstream so that the audio signal may be recovered from the scalable bitstream at the decode rate. Next, at step 650, the decoder uses the side information available at step 630 to reconstruct from the previously selected bits the approximation of the modified spectral coefficients corresponding to the decode rate. Next, at step 660, the decoder decompands the modified spectral coefficients on a subband basis so that the audio signal may be recovered from the scalable bitstream at a fidelity level corresponding to the selected decode bitrate. Then, at step 670, the decoder scales the decompanded modified spectral coefficients on a subband basis at the fidelity level corresponding to the selected decode bitrate. Generally, the scaling operation comprises an inverse scaling operation using the exponent of the scaling factor encoded in the side information for the subband. Then, at step 680, the decoder performs a discrete frequency domain to time domain transform on the ordered, decompanded and scaled modified spectral coefficients to reproduce a version of the audio signal at the fidelity level corresponding to selected decode bitrate.

Thus it is seen that the foregoing description has provided by way of exemplary and non-limiting examples a full and informative description of the best methods and apparatus presently contemplated by the inventors for implementing embedded scalable encoding and decoding of commanded and vector quantized audio data. One skilled in the art will appreciate that the various embodiments described herein can be practiced individually; in combination with one or more other embodiments described herein; or in combination with encoders differing from those described herein. Further, one skilled in the art will appreciate that the present invention can be practiced by other than the described embodiments; that these described embodiments are presented for the purposes of illustration and not of limitation; and that the present invention is therefore limited only by the claims which follow.

What is claimed is:

1. A computer-implemented method comprising:

performing a time domain to discrete frequency domain transformation on an audio signal, generating a plurality of spectral coefficients for each of a plurality of subbands;

scaling, companding and vector quantizing the spectral coefficients for each of the plurality of subbands on a subband basis to generate modified spectral coefficients;

generating side information for each of the plurality of subbands;

bitplane encoding the modified spectral coefficients on a subband basis using a plurality of bitplane levels, the modified spectral coefficients bitplane encoded in descending order of importance; and combining the side information and the bitplane encoded modified spectral coefficients into a scalable bitstream from which the audio signal can be recovered at a scalable rate;

where scaling, companding and vector quantizing the spectral coefficients for each of the plurality of subbands further comprises scaling the spectral coefficients with a first scaling factor, the first scaling factor comprising a first scaling factor base and a first scaling factor exponent, and where at least some of the first scaling factors for certain subbands differ from first scaling factors for other subbands.

2. The method of claim 1, where the scaled, companded and vector quantized spectral coefficients associated with a subband comprise a subband coefficient vector, and where generating side information for each of the plurality of subbands further comprises determining for each subband a maximum norm of the subband coefficient vector.

3. The method of claim 2 where generating side information further comprises, for each subband, entropy encoding the first scaling factor exponent and the maximum norm of the subband coefficient vector.

4. The method of claim 1 where performing a time domain to discrete frequency domain transformation on an audio signal further comprises performing a time domain to discrete frequency domain transformation using a modified-discrete cosine transform.

5. The method of claim 1 where scaling, companding and vector quantizing the spectral coefficients further comprises vector quantizing the spectral coefficients using a lattice method.

6. The method of claim 1 further comprising:

receiving the scalable bitstream;

receiving a selected decode bitrate;

recovering the side information from the scalable bitstream;

selecting sufficient bits encoding the modified spectral coefficients from the scalable bitstream so that the audio signal may be recovered from the scalable bitstream at the selected decode bitrate;

recovering the modified spectral coefficients from the selected bits and the side information;

decompanding the modified spectral coefficients on a subband basis using the selected bits at a fidelity level corresponding to the selected decode bitrate;

scaling the decompanded modified spectral coefficients on a subband basis at the fidelity level corresponding to the selected decode bitrate; and performing a discrete frequency domain to time domain transform on the decompanded and scaled modified spectral coefficients to reproduce a version of the audio signal at the fidelity level corresponding to the selected decode bitrate.

7. A computer-implemented method for audio encoding comprising:

receiving an input audio signal;

performing a time-domain to discrete frequency domain transformation on the input audio signal, the time-domain to discrete frequency domain transformation creating a plurality of frequency domain coefficients;

organizing the frequency domain coefficients by frequency subband;

for each subband:

scaling the frequency domain coefficients with a first scaling factor, wherein the first scaling factor comprises a first scaling factor base and a first scaling factor exponent and where at least some of the first scaling factors for certain subbands differ from first scaling factors for other subbands;

companding the frequency domain coefficients, wherein the scaled and companded frequency domain coefficients comprise a subband coefficient vector;

vector quantizing the subband coefficient vector;

determining a maximum norm of the quantized subband coefficient vector; and encoding the first scaling factor exponent and the maximum norm of the quantized subband coefficient vector, the first scaling factor exponent and the maximum norm of the quantized subband coefficient vector comprising side information for the subband;

bitplane encoding the subband coefficients comprising the subband coefficient vectors on a subband basis using a plurality of bitplane levels, the subband coefficients bitplane encoded in descending order of importance, derived from the first scaling factor and the maximum norm; and combining the subband side information and bitplane encoded subband coefficients into a scalable bitstream from which the audio signal can be recovered at a scalable rate.

8. The method of claim 7 further comprising:

transmitting the scalable bitstream to an electronic device incorporating a decoder configured to decode the scalable bitstream at a selectable bit rate;

receiving a selection of a bitrate at which the audio information encoded in the scalable bitstream is to be decoded; and decoding the audio information encoded in the scalable bitstream at the selected bitrate.

9. The method of claim 7 wherein the selection of the bitrate at which the audio information encoded in the scalable bitstream is to be decoded is pre-determined.

10. The method of claim 7 wherein the electronic device incorporating the decoder is configured to permit user selection of the bitrate at which the audio information encoded in the scalable bitstream is to be decoded.

11. The method of claim 7 further comprising:

calculating the number of bits per coefficient for each subband codevector, based, at least in part, on the maximum norm of the subband coefficient vector;

ordering the subband coefficient vectors by the number of bits per coefficient calculated for each subband, wherein the ordering determines the order of importance of the subband coefficient vectors; and wherein bitplane encoding the subband coefficients further comprise bitplane encoding the subband coefficients in the order of importance of the subbands.

12. The method of claim 7 wherein the discrete frequency domain transformation is performed using a modified-discrete cosine transform.

13. The method of claim 7 wherein the vector quantization is performed using a lattice method.

14. The method of claim 13 wherein the vector quantization is performed using a $Z_n$ lattice, wherein n is the dimension of the subband.

15. The method of claim 11 wherein for a subband i the maximum number of bits per coefficient $nb_i$ for the subband i is calculated from side information associated with the subband according to $$\lceil s_i \log_2 b \log_2 C^{-1}(nrm_i)\rceil+1$$

where $s_i$ is the exponent of the scaling factor for the subband i, b is the base of the scaling factor, $nrm_i$ is the maximum norm of the subband i, and $C^{-1}$ is the inverse of the companding function.

16. The method of claim 15 wherein the maximum number of bits per coefficient for a particular subband indicates a relative level of importance of the subband with respect to the other subbands.

17. The method of claim 15 wherein when bitplane encoding the subband coefficients further comprises bitplane encoding the subband coefficients in the order of importance of the subbands.

18. The method of claim 7 wherein bitplane encoding the subband coefficients further comprises:

for a first bitplane level corresponding to a most significant bitplane level, identifying which subbands are significant at the first bitplane level, wherein significance is determined by identifying which subbands have at least one coefficient value at least equal to the first bitplane level;

for each subband identified as being significant at the first bitplane level, identifying which coefficients are significant at the first bitplane level, wherein significance is determined by identifying which coefficients have values at least equal to the first bit plane level;

in the order of coefficients associated with the subband, if a coefficient is identified as being significant, adding to the bitstream a bit representing the sign of the coefficient, and a bit representing the most significant bit of the coefficient; and if a coefficient is not significant at the first bit plane level, adding a zero bit; and for each successive bitplane level after the first bitplane level wherein, when under consideration, a particular one of the successive bitplane levels after the first bitplane level comprises a current bitplane level, identifying which subbands are significant at the current bitplane level, wherein significance is determined by identifying which subbands have at least one coefficient value at least equal to the current bit plane level;

for each subband identified as being significant at the current bitplane level, identifying which coefficients are significant at the current bitplane level, wherein significance is determined by identifying which coefficients have values at least equal to the current bit plane level;

in the order of coefficients associated with the subband, if a coefficient has been considered at a previous bitplane level, adding a bit to the bitstream corresponding to the current bitplane level bit of the coefficient;

if a coefficient is being considered for the first time, adding to the bitstream a bit representing the sign of the coefficient, and a bit representing the most significant bit of the coefficient; and if a coefficient is not significant at the current bit plane level, adding a zero bit.

19. The method of claim 7 wherein bitplane encoding the subband coefficients further comprises:

for a first bit plane level corresponding to a most significant bitplane level, identifying which subbands are significant at the first bitplane level, wherein significance is determined by identifying which subbands have at least one coefficient value at least equal to the current bitplane level;

for each subband identified as being significant at the first bitplane level, identifying which coefficients are significant at the first bitplane level, wherein significance is determined by identifying which coefficients have values at least equal to the first bit plane level;

for each coefficient identified as being significant, saving information identifying the position of the coefficient within the subband;

adding to a temporary buffer a bit for the sign of the coefficient;

adding a bit corresponding to the most significant bit of the coefficient;

writing the information identifying the position of the coefficient with the subband to the bitstream; and writing contents of the temporary buffer to the bitstream; and for each successive bitplane level after the first bitplane level wherein, when under consideration, a particular one of the successive bitplane levels after the first bitplane level comprises a current bitplane level, identifying which subbands are significant at the current bitplane level, wherein significance is determined by identifying which subbands have at least one coefficient value at least equal to the current bit plane level;

for each subband identified as being significant at the current bitplane level, identifying which coefficients are significant at the current bitplane level, wherein significance is determined by identifying which coefficients have values at least equal to the current bit plane level;

for each coefficient identified as being significant, if a coefficient has been considered at a previous bitplane level, add a bit to the bitstream corresponding to the current bitplane level bit of the coefficient;

if a coefficient is being considered for the first time, saving information identifying the position of the coefficient within the subband;

adding to the temporary buffer a bit for the sign of the coefficient;

adding to the temporary buffer a bit corresponding to the most significant bit of the coefficient; and writing the information identifying the position of the coefficient within the subband to the bitstream;

writing the contents of the temporary buffer to the bitstream.

20. An encoder comprising:

a transform unit adapted to perform a time domain to discrete frequency domain transformation on an audio signal, generating a plurality of spectral coefficients for each of a plurality of subbands;

a scaling unit adapted to scale the spectral coefficients with a first scaling factor, the first scaling factor comprising a first scaling factor base and a first scaling factor exponent, and where at least some of the first scaling factors for certain subbands differ from first scaling factors for other subbands;

a companding unit adapted to compand the spectral coefficients;

a quantizing unit adapted to vector quantize the spectral coefficients on a subband basis, the scaling, companding and quantizing units together generating modified spectral coefficients;

a side information generating unit adapted to generate side information for each of the plurality of subbands; and a bitplane encoding unit adapted to bitplane encode the modified spectral coefficients on a subband basis using a plurality of bitplane levels, the modified spectral coefficients bitplane encoded in descending order of importance; the bitplane encoding unit further adapted to combine the side information with the bitplane encoded modified spectral coefficients to form a scalable bitstream from which the audio signal can be recovered at a scalable rate.

21. The encoder of claim 20 where the transform unit is adapted to perform a time domain to discrete frequency domain transform on the audio signal using a modified-discrete cosine transform.

22. The encoder of claim 20 where the quantizing unit is adapted to vector quantize the spectral coefficients using a lattice method.

23. The encoder of claim 22 vector quantization is performed using an n-dimensional lattice, where n is the dimension of the subband.

24. An electronic device comprising:

a transform unit adapted to receive an input audio signal, to perform a time-domain to discrete frequency domain transformation, the time domain to discrete frequency domain transformation creating a plurality of frequency domain coefficients, and to organize the frequency domain coefficients by frequency subband;

a scaling unit adapted to scale frequency domain coefficients associated with each subband with a first scaling factor, wherein the first scaling factor comprises a first scaling factor base and a first scaling factor exponent, and wherein at least some of the first scaling factors for certain subbands differ from first scaling factors for other subbands;

a companding unit adapted to compand the scaled frequency domain coefficients associated with each subband, wherein the scaled and companded frequency domain coefficients comprise scaled, companded subband coefficient vectors;

a quantizing unit adapted to vector quantize the scaled, companded subband coefficient vectors;

a side information unit adapted to encode side information for each subband, the side information comprising the first scaling factor exponent associated with the scaling factor applied to the subband, and a maximum norm of the quantized subband coefficient vector associated with the subband; and a bitplane encoding unit adapted to bitplane encode using a plurality of bitplane levels the subband coefficients comprising the vector quantized, companded and scaled subband coefficient vectors, the bitplane encoding unit further adapted to generate a scalable bitstream by combining the bitplane encoded subband coefficients and the side information.

25. The electronic device of claim 24, where the side information unit is adapted to entropy encode side information for each subband.

26. A tangible memory medium storing a computer program executable by a digital processing apparatus of an electronic device, wherein when the computer program is executed operations are performed, the operations comprising:

receiving an input audio signal;

performing a time-domain to discrete frequency domain transformation, the time domain to discrete frequency domain transformation creating a plurality of frequency domain coefficients;

organizing the frequency domain coefficients by frequency subband;

for each subband:

scaling the frequency domain coefficients with a first scaling factor, wherein the first scaling factor comprises a first scaling factor base and a first scaling factor exponent and where at least some of the first scaling factors for certain subbands differ from first scaling factors for other subbands;

companding the frequency domain coefficients, wherein the scaled and companded frequency domain coefficients comprise a subband coefficient vector;

vector quantizing the subband coefficient vector;

determining a maximum norm of the quantized subband coefficient vector;

encoding the first scaling factor exponent and the maximum norm of the quantized subband coefficient vector, the first scaling factor exponent and the maximum norm of the quantized subband coefficient vector comprising subband side information for the subband; and bitplane encoding the subband coefficients using a plurality of bitplane levels, and combining the bitplane encoded subband coefficients with the subband side information to create an embedded scalable bitstream.

27. The tangible memory medium of claim 26 where the time domain to discrete frequency domain transformation is performed using a modified-discrete cosine transform.

28. The tangible memory medium of claim 26 where the vector quantization is performed using a lattice method.

29. The tangible memory medium of claim 26 where the operations further comprise:

receiving the embedded scalable bitstream;

receiving a selected decode bitrate;

recovering subband side information from the scalable bitstream;

selecting sufficient bits encoding the subband coefficients from the embedded scalable bitstream so that the audio signal may be recovered from the embedded scalable bitstream at the selected decode bitrate;

recovering the subband coefficients from the embedded scalable bitstream using the selected bits and the side information at a fidelity level corresponding to the selected decode bitrate, the side information used to obtain the order of significance of the subbands;

decompanding the subband coefficients on a subband basis at the fidelity level corresponding to the selected bitrate;

scaling the decompanded subband coefficients on a subband basis at the fidelity level corresponding to the selected decode bitrate; and performing a discrete frequency domain to time domain transform on the decompanded and scaled subband coefficients to reproduce a version of the audio signal at the fidelity level corresponding to the selected decode bitrate.

30. A decoder comprising:

a side information unit adapted to recover subband side information from a scalable bitstream comprised of bitplane-encoded modified spectral coefficients and the subband side information, the bitplane-encoded modified spectral coefficients encoding an audio signal recoverable at a scalable bitrate, the modified spectral coefficients modified as a result of scaling, companding and vector quantizing operations performed by an encoder;

a bitplane decoding unit adapted to receive both a selected decode bitrate, the decoded side information, and the scalable bitstream, to select sufficient bits encoding the modified spectral coefficients on a bitplane level basis from the scalable bitstream so that the audio signal may be reproduced at a fidelity level corresponding to the selected decode bitrate, and to use the side information to obtain the subband order of significance and to obtain the modified spectral coefficients and their significance;

a decompanding unit adapted to decompand the modified spectral coefficients on a subband basis at the fidelity level corresponding to the selected decode bitrate using the bits selected by the bitplane decoding unit;

a scaling unit adapted to scale the decompanded modified spectral coefficients on a subband basis at the fidelity level corresponding to the selected decode bitrate by scaling the spectral coefficients on each subband with a first scaling factor, the first scaling factor comprising a first scaling factor base and a first scaling factor exponent, and where at least some of the first scaling factors for certain subbands differ from first scaling factors for other subbands; and a transform unit adapted to perform a discrete frequency domain to time domain transform on the ordered, scaled and decompanded modified spectral coefficients to reproduce a version of the audio signal at the fidelity level corresponding to the selected decode bitrate.

* * * * *

UNITED STATES PATENT AND TRADEMARK OFFICE

CERTIFICATE OF CORRECTION

PATENT NO. : 7,689,427 B2
APPLICATION NO. : 11/485076
DATED : March 30, 2010
INVENTOR(S) : Vasilache It is certified that error appears in the above-identified patent and that said Letters Patent is hereby corrected as shown below:

Claim 15, col. 16, line 5 delete " $\lceil s_i \log_2 b \quad \log_2 C^{-1}(nrm_i) \rceil + 1$ " and insert -- $\lceil s_i \log_2 b + \log_2 C^{-1}(nrm_i) \rceil + 1$ --.

Signed and Sealed this

Twenty-fifth Day of May, 2010

David J. Kappos

David J. Kappos
*Director of the United States Patent and Trademark Office*